United States Patent [19]

Okunomiya

[11] Patent Number: 4,909,649

[45] Date of Patent: Mar. 20, 1990

[54] THERMAL TRANSFER RECORDING APPARATUS

[75] Inventor: Seizi Okunomiya, Katsuta, Japan

[73] Assignee: Hitachi, Ltd., Tokyo, Japan

[21] Appl. No.: 386,103

[22] Filed: Jul. 28, 1989

Related U.S. Application Data

[63] Continuation of Ser. No. 86,822, Aug. 19, 1987, abandoned.

[30] Foreign Application Priority Data

Aug. 25, 1986 [JP] Japan ..... 61-197106

[51] Int. Cl.[4] ..... B41J 11/36

[52] U.S. Cl. ..... 400/583.4; 400/185; 400/120; 400/567; 400/568; 400/556

[58] Field of Search ..... 400/565, 551, 583.4, 400/54, 556, 567, 568, 569, 120, 185

[56] References Cited

U.S. PATENT DOCUMENTS

| | | | |
|---|---|---|---|
| 1,847,316 | 3/1932 | Sundstrand | 400/565 |
| 2,069,550 | 2/1937 | McMillan | 400/556 |
| 3,280,957 | 10/1966 | Thiel | 400/567 |
| 3,601,297 | 8/1971 | Funk et al. | 400/583.4 |
| 4,090,410 | 5/1978 | Nakamura | 400/569 |
| 4,217,057 | 8/1980 | Nakamura | 400/567 |
| 4,347,006 | 8/1982 | Shakib | 400/569 |
| 4,549,826 | 10/1985 | Stoeberl | 400/54 |
| 4,675,698 | 6/1987 | Tsutsumi | 400/120 |
| 4,775,869 | 10/1988 | Minowa | 400/185 |

FOREIGN PATENT DOCUMENTS

| | | | |
|---|---|---|---|
| 69077 | 4/1982 | Japan | 400/583.4 |
| 92884 | 5/1985 | Japan | 400/120 |
| 54972 | 3/1986 | Japan | 400/120 |
| 116569 | 6/1986 | Japan | 400/187 |
| 270366 | 11/1987 | Japan | 400/120 |
| 282947 | 12/1987 | Japan | 400/120 |
| 4982 | 1/1988 | Japan | 400/120 |

*Primary Examiner*—William Pieprz

*Attorney, Agent, or Firm*—Antonelli, Terry & Wands

[57] ABSTRACT

A thermal transfer recording apparatus wherein it comprises a power transmitting device for transmitting power from a driving motor of the apparatus to a platen roller of the apparatus, which device can change rotational speed of the platen roller to rotate the platen roller at high speed, thereby shortening a non-printing time such as required for introduction and ejection of a recording paper to reduce the total recording time of the thermal transfer recording apparatus. Further, the power transmitting device has a neutral position where the platen roller can be freely rotated, thereby easily restoring the recording apparatus to its normal conditions even when the recording paper and/or an inked ribbon is jammed.

8 Claims, 5 Drawing Sheets

THERMAL TRANSFER RECORDING APPARATUS

This is a continuation of application Ser. No. 086,822, filed Aug. 19, 1987, now abandoned.

BACKGROUND OF THE INVENTION

The present invention relates to a thermal transfer recording apparatus wherein an inked ribbon and a recording paper are overlapped and urged against a platen roller with the inked ribbon outside, and recording paper is recorded or printed by applying heat onto the inked ribbon by means of a thermal head while the platen roller is rotated by a driving motor through the medium of a power transmitting device. More particularly, in the present invention relates to a thermal transfer recording apparatus having an improved reduction ratio changing over mechanism useful for the power transmitting device for the platen roller.

In a conventional reduction mechanism of a power transmitting device for transmitting rotational power from a driving motor to a platen roller used for a thermal transfer apparatus, since the reduction mechanism was connected to the driving motor with a constant reduction ratio, in order to shorten or reduce non-printing time such as required for introduction and ejection of the recording paper, a method in which the rotational speed of the driving motor is increased to rotate the platen roller faster has been used. However, in this method, since the reduction ratio of the reduction mechanism is constant or unchangeable and the output of the driving motor is limited, the total recording time could not be reduced beyond a certain degree. Thus, in order to still further reduce the total recording time to obtain a high speed recording apparatus, it was required to utilize a driving motor having a higher output and capable of rotating at higher speed, which was large-sized and expensive. Further, in the conventional thermal transfer recording apparatus, since the rotation of the platen roller was regulated by the reduction mechanism, when the recording paper was jammed in a path of movement thereof and/or the inked ribbon was caught by the platen roller, the jammed recording paper or inked ribbon could not be removed unless a part of the power transmitting device or a guiding means for the recording paper was dismantled; thus, in this case, a great deal of time and labor were required to restore the recording apparatus to the original or normal state. In order to relieve the above inconvenience, a technique in which the guiding means for the recording paper is constituted by a plurality of parts and is openable for access to the periphery of the platen roller has been proposed. However, this technique has a disadvantage that the recording paper guiding means is complicated and a large space is required to permit the swinging movement of the guiding means, thereby preventing or opposing to the compactness and cost reducing of the apparatus. These conventional techniques are described in, for example, the Japanese Patent Publication Nos. 60954/1982 and 52756/1981.

Accordingly, an object of the present invention is to provide a thermal transfer recording apparatus having a power transmitting device which can eliminate the above-mentioned conventional drawbacks and which is inexpensive, and which can reduce the total recording time and easily cope with the jamming of the recording paper and inked ribbon.

The above object of the invention is achieved by providing a power transmitting device for transmitting the power from the driving motor to the platen roller in which the rotational speed of the platen roller can be changed by a reduction ratio changing-over mechanism and which has a neutral position where the platen roller can be rotated freely.

Therefore, according to the present invention, the platen roller can be rotated at high speed even during the non-printing period such as required for introduction and ejection of the recording paper, thereby reducing the total recording time of the thermal transfer recording apparatus. Further, since the platen roller can be freely rotated by bringing the power transmitting device to the neutral position, the jamming of the recording paper and/or inked ribbon can be easily removed, thereby swiftly restoring the recording apparatus to the normal conditions.

According to a preferred embodiment of the present invention, there is provided a thermal transfer recording apparatus wherein an inked ribbon and a recording paper are overlapped and urged against a platen roller with the inked ribbon outside and the recording paper is recorded by applying heat onto the inked ribbon by means of a thermal head while the platen roller is rotated by a driving motor through the medium of a power transmitting device and characterized in that said power transmitting device comprises a low speed rotational drive transmitting means for rotating the platen at low speed to perform the recording on the recording paper, a high speed rotational drive transmitting means for rotating the platen roller at higher speed than said low speed, and a rotational speed changing-over means for changing one of said low or high speed rotational drive transmitting means over to the other to connect the changed-over rotational drive transmitting means to the platen roller so that the platen roller is rotated at said low speed or at said higher speed.

Preferably, the thermal transfer recording apparatus of the present invention further includes a detecting means for detecting abnormality of the inked ribbon and/or recording paper such as a jam in a recording paper and inked ribbon moving system and a controlling means for permitting the free rotation of the platen roller by causing the rotational speed changing-over means to automatically change the power transmitting device over to its neutral position when the detecting means detects the abnormality.

BRIEF DESCRIPTION OF THE DRAWINGS

FIGS. 4 to 6 show partial sectional views of a power transmitting device of the thermal transfer recording apparatus, wherein FIG. 4 shows a condition in which a platten roller of the recording apparatus is rotated at high speed;

FIG. 5 shows a condition in which the platen roller is rotated at low speed, and FIG. 6 shows a neutral condition where the platen roller can be freely rotated.

DETAILED DESCRIPTION OF THE PREFERRED EMBODIMENT

Figure 1:
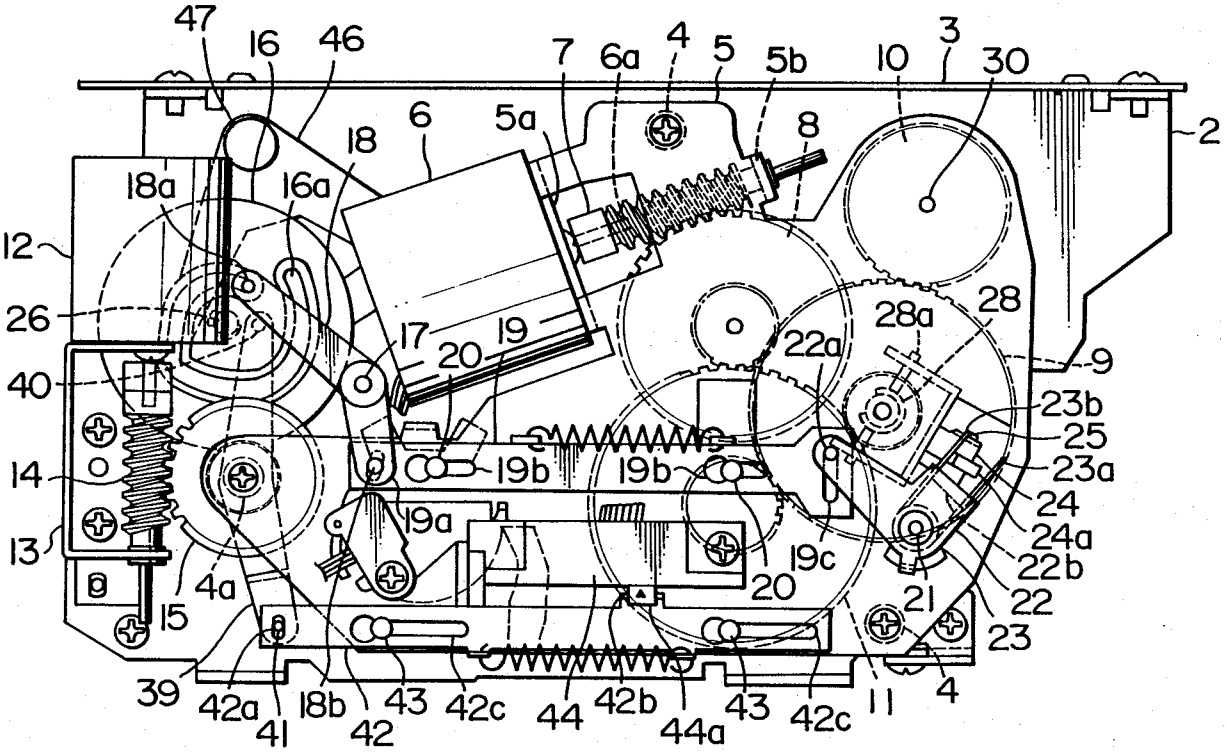
FIG. 1 is an elevational side view of a thermal transfer recording apparatus according to a preferred embodiment of the present invention.
Figure 2:
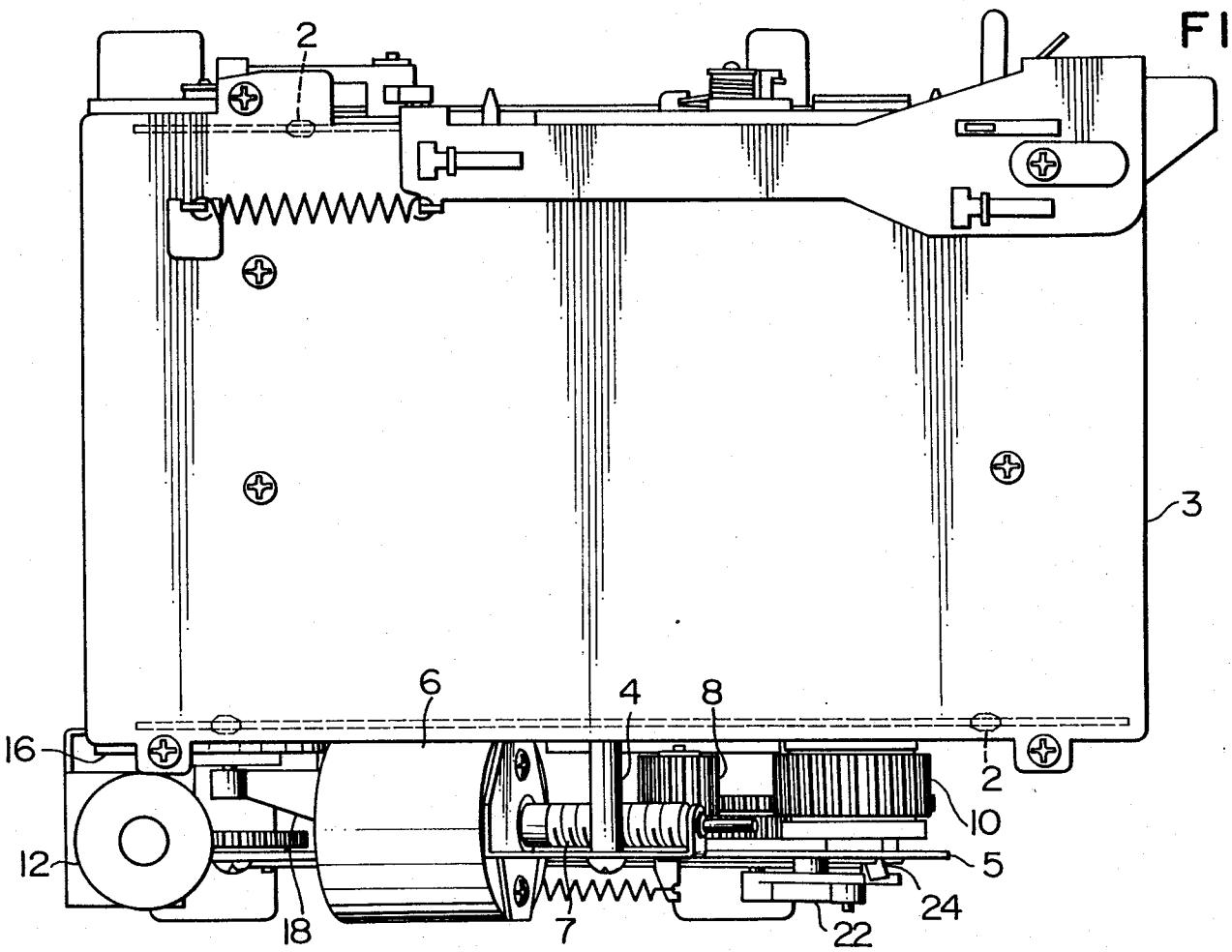
FIG. 2 is a top view of the thermal transfer recording apparatus shown in FIG. 1.
Figure 3:
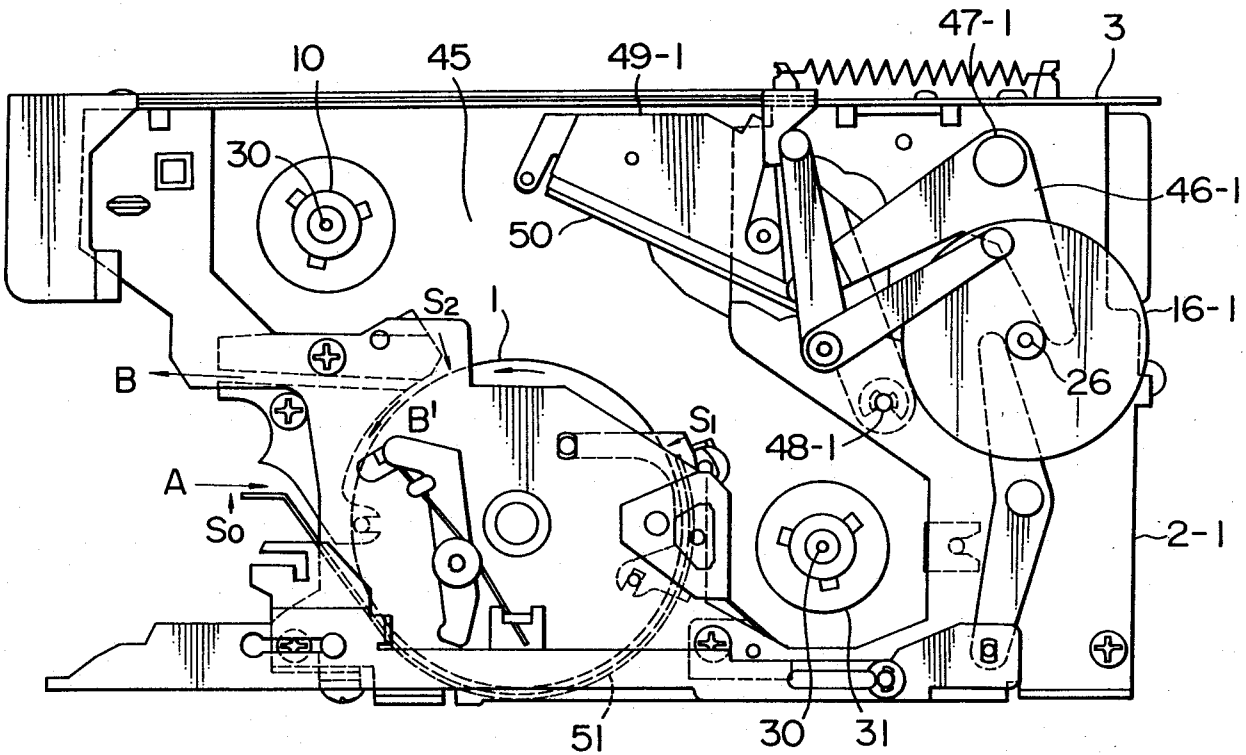
FIG. 3 is a rear side view looked at from a rear side of FIG. 2.

The present invention will now be explained in connection with a preferred embodiment thereof illustrated in the drawings. In FIGS. 1 to 3, a thermal transfer recording apparatus according to the present invention has a portal construction comprised of a pair of main chassises 2, 2 arranged on both sides of the recording apparatus and a top plate 3 bridged between and mounted on the main chassises 2. As shown in FIGS. 1 and 2, a plurality of shafts 4, 4, 4*a* are fixed to and projected forwardly from the front main chassis 2. A side chassis 5 is fixed to outer ends of these shafts 4, 4, 4*a* by means of screws. The side chassis 5 has a bent portion 5*a* on which a motor 6 is mounted A worm 7 is coaxially fixed to an output shaft 6*a* of the motor 6, a free end of the worm 7 being rotatably supported by another bent portion 5*b* of the side chassis 5. The worm 7 is engaged by a larger gear portion 8*a* (FIG. 4) of a worm wheel 8 rotatably mounted between the side chassis 5 and the front main chassis 2, the worm wheel 8 further having a smaller gear portion 8*b* which is coaxial with the larger gear portion 8*a* and is engaged by a larger gear portion 9*a* of a change-over gear 9. This larger gear portion 9*a* is also engaged by a smaller gear portion 11*a* of a drum gear 11 fixed, by a press fit, on a shaft 1*a* of a platen roller 1. Further, the larger gear portion 9*a* of the change-over gear 9 is always engaged by a take-up reel capstan 10 rotatably mounted behind the side chassis 5, as will be fully described hereinbelow. Accordingly, power generated by the motor 6 (FIG. 1) can be transmitted to the change-over gear 9 through the worm 7 and the worm wheel 8, and then be transmitted from the change-over gear 9 to the take-up capstan 10 and the drum gear 11.

In FIG. 1, a motor 12 is attached to an outer side of a branch of a bracket 13 fixed, by screws, to the left end portion of the main chassis 2. A worm 14 similar to the worm 7 is coaxially fixed to an output shaft of the motor 12, the worm 14 being situated in the bracket 13 and being rotatably supported, at its free end, by another branch of the bracket 13. The worm 14 is engaged by a larger gear portion of a worm wheel 15 rotatably mounted on the fixed shaft 4*a* protruded from the front main chassis 2. The worm wheel 15 has a smaller gear portion which is coaxial with the larger gear portion and which is engaged by a cam gear 16 fixed to one end of a shaft 26 passing through and rotatably mounted on the pair of main chassises 2, 2. On the other end of the shaft 26, another cam gear 16-1 (FIG. 3) is fixed. Accordingly, power generated by the motor 12 can be transmitted to the worm wheel 15 through the worm 14 and then be transmitted from the worm wheel 15 to the pair of cam gears 16 and 16-1. The cam gear 16 is provided, on its front surface, with a cam groove 16*a* (FIG. 1) by which a pin 18*a* is engaged. The pin 18*a* is fixed to one end of an arm 18 rotatably mounted on a pin 17 fixed to and projected from the main chassis 2. A pin 18*b* fixed to the other end of the arm 18 is housed in an elongated slot 19*a* formed in a left end portion of a change-over slider 19. The slider 19 is slidably supported on the side chassis 5 by means of a pin-slot connection constituted by a pair of elongated slots 19*b*, 19*b* formed in the slider 19 and a pair of pins 20, 20 engaged by said elongated slots and fixed to the side chassis 5. The change-over slider 19 is provided, at the other end thereof, with a longitudinal slot 19*c* in which a pin 22*a* fixed to one end of a change-over arm 22 of synthetic resin rotatably mounted on a pin 21 fixed to the side chassis 5. More particularly, the change-over arm 22 has a boss rotatably fitted on the pin 21. A spring 23 is wound around the boss of the arm 22 and has end arm portions 23*a* and 23*b*. The end arm portions 23*a* and 23*b* are abutted, at their intermediate points, against a projection 22*b* formed on the arm 22 and can be biased in clockwise and anti-clockwise directions, respectively. Between the end arm portions 23*a*, 23*b* of the spring 23, a projection 24*a* of a change arm 24 of synthetic resin is positioned. The change arm 24 is rotatably mounted on a pin 25 (particularly, clearly shown in FIGS. 5 and 6) fixed to a bent portion (not shown) formed on a rear surface of the side chassis 5 (FIG. 1), and the projection 24*a* of the arm 24 protrudes forwardly through a hole of the side chassis 5 to extend between the end arm portions 23*a* and 23*b* of the spring 23.

In FIG. 1, a link 39 is rotatably mounted on the fixed shaft 4*a* coaxial with the worm wheel 15 between said worm wheel 15 and the main chassis 2. A pin 40 fixed to one end of the link 39 is engaged by a cam groove (not shown) formed on a rear surface of the cam gear 16 opposite to the front surface including the cam groove 16*a*. A pin 41 fixed to the other end of the link 39 is engaged by an elongated slot 42*a* formed in a mode slider 42. The mode slider 42 is slidably supported on the side chassis 5 by means of a pin-slot connection constituted by a pair of elongated slots 42*c* formed in the mode slider and a pair of pins 43 engaged by said elongated slots and fixed to the side chassis 5. A bent portion 42*b* formed on the mode slider 42 cooperates with a movable contact 44*a* of a position mode switch 44 attached to the side chassis 5. The position mode switch 44 detects an angular position of the cam gear 16 through the link 39 and the mode slider 42 and generates a detect signal. A microprocessor (not shown) receives the detect signal and controls the rotation of the motor 12.

The change-over gear 9 is rotatably mounted on a pin 27 (FIGS. 4–6) fixed to and protruded forwardly from the right side part of the side chassis 5 and is slidable in a direction of axis of the pin 27. A ring 28 of synthetic resin is rotatably housed into a recess formed in the change-over gear 9. A pair of arms 28*a* of the ring 28 pass through and are engaged by a pair of corresponding elongated slots 24*c* formed in a pair of arm portions 24*b* of the change arm 24. The above-mentioned worm wheel 8 is rotatably mounted on a pin 2 fixed to and protruded from the central part of the side chassis 5.

Further, on pins 30, 30 (FIGS. 1 and 4) fixed to and protruded rearwardly from the side chassis 5 at its both end parts, the take-up reel capstan 10 and a feed reel capstan 31 are rotatably mounted, respectively. The pins 30, 30 are arranged in such a position that, as shown in FIG. 3, the take-up reel capstan 10 and the feed reel capstan 31 are situated in upper and lower positions, respectively, with the interposition of the platen roller 1.

Figure 4:
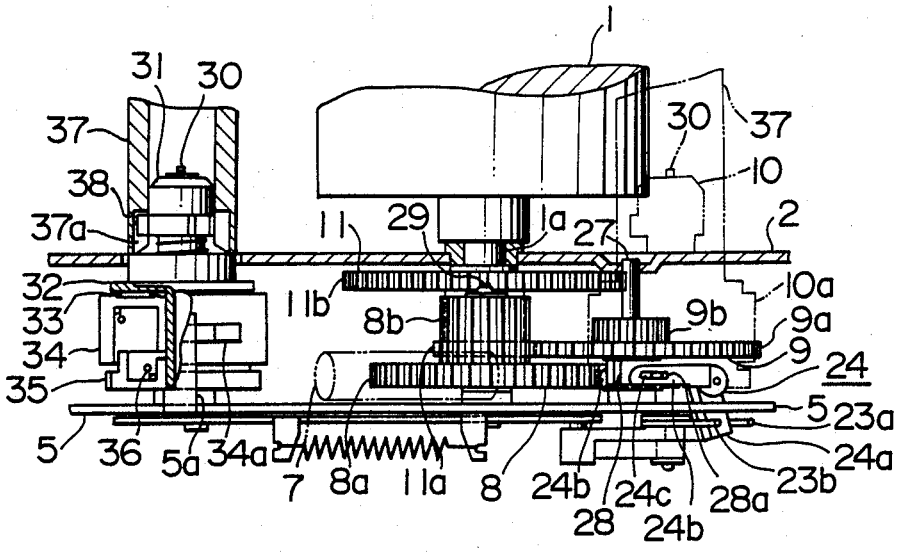

As clearly shown in FIG. 4, a reel 34 rotatably fitted on a felt member 33 fixed to a base member 32 of the capstan 31 is abutted against the feed reel capstan 31 by means of a spring 36; a spring shoe 35 is fixed to the base member 32 by a press fit; further, the rotation of the reel 34 is regulated by abutting a projection 34*a* of the reel 34 against the bent portion 5*a* of the side chassis 5. Therefore, a friction clutch mechanism is obtained by these elements 33, 34, 34*a*, 5*a*, 36 and the like. The take-up reel capstan 10 has the same construction (not explained in detail) as that of the above-mentioned feed reel capstan 31, wherein a portion 10*a* corresponding to the reel 34 is provided with a gearing by which the above-mentioned larger gear portion 9*a* of the change-over gear 9 is always engaged.

A inked ribbon cassette (not shown) can be mounted on the thermal transfer recording apparatus by fitting a pair of tubular shafts 37, 37 of inked ribbon spools (not shown) of the cassette onto the take-up reel capstan 10 and the feed reel capstan 31. Rotational power to the inked ribbon spools in the cassette is transmitted through the medium of a plurality of projections 38 on the feed reel capstan 31 and corresponding recesses formed in the tubular shaft 37 fitted on the capstan 31.

Referring to FIG. 3, a thermal head 50 is positioned above the platen roller 1. With regard to the thermal head 50, a pair of drivinq arms 46-1 and 46 are rotatably mounted on pins 47-1 and 47 fixed to a right upper part of the rear main chassis 2-1 (FIG. 3) and to a corresponding left upper part of the front main chassis 2 (FIG. 1), respectively. The driving arms 46 and 46-1 are engaged by cam grooves (not shown) formed in the rear surfaces of the cam gears 16-1 and 16, respectively, and can be driven by the motor 12. A pin 48-1 (FIG. 3) is fixed to the main chassis 2-1 at the left side with respect to the cam gear 16-1 and a corresponding pin 48 (not seen in the drawings) is fixed to the main chassis 2 (FIG. 1) at a position corresponding to the pin 48-1. On the pair of said pins 48-1 and 48, a pair of head arms 49-1 and 49 are rotatably mounted (the arm 49 cannot be seen in the drawings). The thermal head 50 is attached to these head arms 49-1, 49 by screws at a predetermined position.

In FIG. 3, a recording paper (not shown) is introduced into the recording apparatus from a direction shown by an arrow A and is moved along the periphery of the platen roller 1 in an anti-clockwise direction by means of appropriate rollers (not shown) and then is discharged from the recording apparatus in a direction shown by an arrow B. A plurality of sensors So, $S_1$ and $S_2$ are arranged in the path of movement of the recording paper, which sensors detect the recording paper and generate corresponding signals for changing over a reduction ratio of the change-over gear 9, said signals being sent to the microprocessor (not shown).

Now, if the change-over signal generated by the sensor $S_1$ is sent to the microprocessor (not shown), the motor 12 (FIG. 1) is energized to rotate the cam gear 16 through the worm wheel 15 in a clockwise direction. By the clockwise rotation of the cam gear 16, the arm 18 is also rotated in a clockwise direction, thereby sliding the change-over slider 19. When the slider 19 is shifted in the left (FIG. 1), the change-over arm 22 is rotated in an anti-clockwise direction to rock the projection 24*a* of the change arm 24 in a clockwise, thereby bringing the change arm 24 in a position shown in FIG. 5. Meanwhile, the mode slider 42 is also shifted in the left by the rotation of the cam gear 16 (FIG. 1), thereby actuating the position mode switch 44. When the change-over signal from the position mode switch is sent to the microprocessor, the microprocessor generates a command signal for stopping the rotation of the motor 12, thereby deenergizing the motor 12. In this way, the change-over operation is completed. During the change-over (of the reduction ratio) operation by means of the motor 12, the motor 6 is maintained in deenergized condition by the control signal from the microprocessor. The motor 6 is again energized when the microprocessor receives the change-over completion signal from the position mode switch 44.

Figure 5:
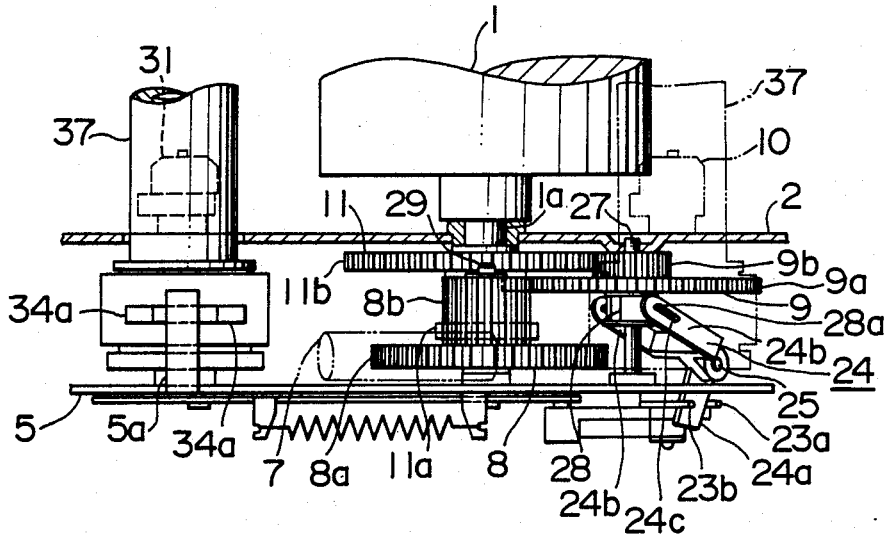
Figure 6:
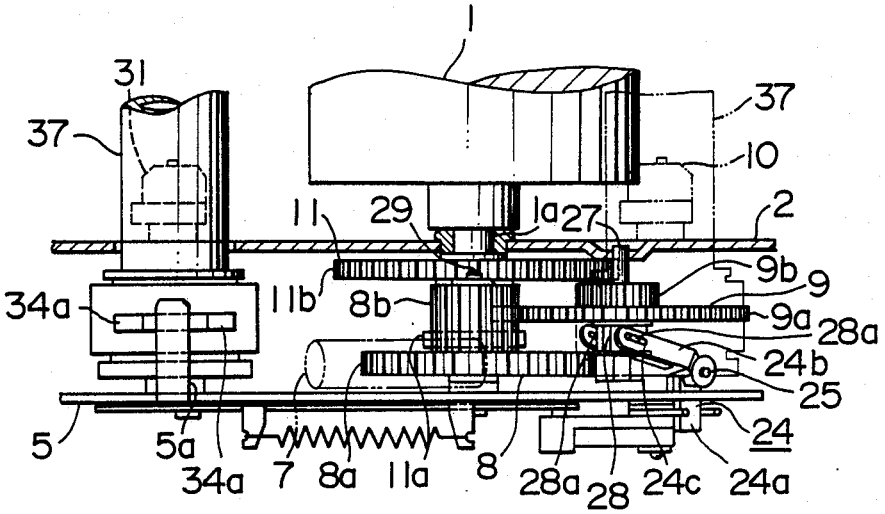

In a position shown in FIG. 5, the change arm 24 lifts the change-over gear 9 to engage a smaller gear portion 9*b* of the change-over gear 9 by a larger gear portion 11*b* of the drum gear 11, whereby, in a low speed condition, the rotational power from the motor 6 is transmitted to the platen roller 1. Meanwhile, since the cam gear 16-1 (FIG. 3) is rotated in an anti-clockwise direction, the driving arm 46-1 is also rotated in an anti-clockwise direction to .rotate the head arms 49-1, 49 in an anti-clockwise direction, thereby urging the thermal head 50 against the platen roller 1. In this case, the thermal head 50 applies a predetermined urging force to the platen roller 1 by means of an appropriate sprig (not shown). Further in this case, the thermal head 50 acts on the inked ribbon (not shown) to urge or press it against the recording paper (not shown) which is positioned on the platen roller 1 and which is shifted or moved together with the rotation of the platen roller. When the inked ribbon is pressed against the recording paper, one image (for one frame or field) with one color is recorded or printed on the recording paper; in dependence on current pulses applied to heating elements of the thermal head 50.

Next, the recording operation on the recording paper will now be explained with reference to FIG. 3. When the recording paper (not shown) is discriminated or distinguished by the sensor $S_0$, the recording paper is introduced into the recording apparatus from the direction shown by the arrow A and is moved along the periphery of the platen roller in an anti-clockwise direction by means of a guide 51 arranged adjacent to the periphery of the platen roller 1. When a leading edge of the recording paper is detected by the sensor $S_1$, the platen roller 1 temporarily stops. During this, the thermal head 50 is lowered to press the inked ribbon (not shown) against the recording paper on the platen roller. Thereafter, the recording is moved together with the inked ribbon by the rotation of the platen roller 1. When the recording paper is further moved in an anti-clockwise direction and the leading edge thereof is detected by the sensor $S_2$, the recording or printing with the first color is initiated.

During this printing, the recording paper is led in a direction shown by an arrow B′ to be shifted along the periphery of the platen roller 1. When a trailing edge of the recording paper is detected by the sensor $S_2$, the detect signal from this sensor is sent to the microprocessor (not shown), thereby rotating or energizing the motor 12. In this case, since the motor is rotated in a direction opposite to the previous one, the change-over slider 19 shifts in the right to rotate the change-over arm 22 in a clockwise direction so that the projection 24*a* of the change arm 24 is rocked in an anti-clockwise by means of the end arm position 23*b* of the spring 23, thereby changing to a condition shown in FIG. 4. In this condition, since the large gear portion 9*a* of the change-over gear 9 is engaged by the smaller gear portion 11*a* of the drum gear 11, the rotational power of the motor 6 is transmitted to the platen roller 1 in a high speed mode or condition. When the recording paper is again moved to the sensor $S_2$, the second recording with the second color is initiated. After the second printing is completed, the recording paper is again moved along the periphery of the platen roller 1 at high speed, and when the recording paper is again detected by the sensor $S_2$, the third printing with the third color is initiated. During the third recording, the recording paper is moved in the direction shown by the arrow B and then is discharged from the recording apparatus. In this way, the recording paper is continuously printed with three colors such as yellow, magenta and cyan, and when third recording is completed, the thermal head 50 is lifted and the recording paper is ejected or discharged from the recording apparatus at high speed by changing over the reduction ratio.

Lastly, if the inked ribbon is jammed into the platen roller system, paper jam detecting sensor(s) (not shown) detects a jammed condition and sends a jam signal to the microprocessor (not shown). When the microprocessor receives the jam signal, it deenergizes or stops the motor 6 and energizes the motor 12, thereby bringing the change-over gear pin a position shown in FIG. 6 from the position of FIG. 4 or FIG. 5. The position of the change-over gear 9 is controlled by the projection 24*a* of the change arm 24 and the end arm portions 23*a*, 23*b* of the spring 23. In the position shown in FIG. 6, the change-over gear 9 is in a neutral position wherein this gear 9 is not engaged by either the larger gear portion 11*b* of the drum gear 11 or the smaller gear portion 11*a* of the drum gear 11 and thus the platen roller 1 can be freely rotated. With this construction, if an operator takes out the inked ribbon cassette (not shown) from a cassette inlet 45 provided at a front side of the main chassis 2-1 (FIG. 1), the jammed inked ribbon or the recording paper can easily removed from the platten roller system, since the platen roller 1 can be freely rotated.

According to the present invention, since the reduction ratio with respect to the platen roller can be changed over on the basis of need, a high speed operation can be realized in non recording condition such as the introduction and ejection of the recording paper, thereby shortening the total recording time. Further, when the recording paper or the inked ribbon is jammed into the platen roller system, since the platen roller can be freely rotated independently of the motor driving and transmitting systems, the jammed inked ribbon or the recording paper can be easily taken out from the cassette inlet.

What is claimed is:

1. A thermal transfer recording apparatus, wherein an inked ribbon and recording paper are overlapped and urged against a platen roller with the recording paper between the inked ribbon and platen roller and recording on the recording paper is effected by applying heat to the inked ribbon with a thermal head while the platen roller and an ink ribbon reel capstan device having a gear portion connected thereto for driving the inked ribbon are rotated by a driving means, said driving means, comprising:

a motor;

a worm wheel having coaxial larger and smaller gear portions thereon, said larger gear portion operatively connected to the motor said worm wheel mounted for rotation about an axis;

a change-over gear movable between a first position and a second position in parallel with the rotation axis of the worm wheel while being engaged with said smaller gear portion of the worm wheel and said gear portion of the reel capstan device;

a thermal head mounted for movement between a first print enabling location in contact with said overlapped ink ribbon and recording paper supported by said platen roller and a second non-print enabling location spaced from said platen roller;

a drum gear fixed to a shaft of the platen roller, and having a larger gear portion operative to be engaged with a smaller gear portion of the change-over gear when the change-over gear is moved to said first position, and a smaller gear portion operative to be engaged with a larger gear portion of the change-over gear when the change-over gear is moved to said second position;

a rotational speed change-over means for moving the change-over gear to the first position or to the second position, and means for moving the thermal head into operative relationship with the platen roller to effect transfer recording when the change-over gear is in the first position and means for coupling said rotational speed change-over means and said thermal head moving means so as to move the thermal head into operative relationship with the platen roller when the change-over gear is moved to the first position, wherein the larger gear portion of the drum gear has a predetermined axially spacing from the smaller gear portion, and the rotational speed change-over means is operable to move the change-over gear to a neutral position intermediate the first and second positions within the predetermined axial spacing so that the change-over gear is not engaged with either the larger or smaller gear portion of the drum gear, thereby disconnecting said platen roller from said motor and enabling the platen roller to be rotated freely.

2. A thermal transfer recording apparatus according to claim 1, wherein said rotational speed change-over means includes a second motor, a second worm wheel operatively connected to the second motor, a first cam gear with a cam groove fixed to a shaft and operatively connected with the second worm wheel, a second cam gear fixed to the shaft, a change-over slider operatively associated with the cam groove of the first cam gear such that the change-over sliders is moved substantially rectilinearly upon rotation of the second motor, a change-over arm operatively connected with the change-over slider and arranged to effect movement of the change-over gear between the first position and the second position.

3. A thermal transfer recording apparatus according to claim 2, wherein said rotational speed change-over means further comprises a mode slider operatively connected with the first cam gear, and a position mode slider operatively cooperating with the mode slider to detect an angular position of the first cam gear.

4. A thermal transfer recording apparatus according to claim 2, wherein said rotational speed change-over means further comprises drive arms means arranged to be driven by the second motor and operatively connected with the first and second cam gears for moving the thermal head to and from the platen roller.

5. A thermal recording apparatus according to claim 4, wherein said rotational speed change-over means further comprises a mode slider operatively connected with the first cam gear, and a position mode slider operatively cooperating with the mode slider to detect an angular position of the first cam gear.

6. A thermal transfer recording apparatus according to claim 1, characterized in that said rotational speed changing-over means is driven by a driving system independently of said motor.

7. A thermal transfer recording apparatus according to claim 1, further comprising a detecting means for detecting abnormality of said inked ribbon and/or recording paper such as a jam in a recording paper and inked ribbon moving system, and a controlling means for permitting the free rotation of said platen roller by causing said rotational speed changing-over means to automatically change said driving means over to said neutral position when said detecting means detects said abnormality.

8. A method for recording by thermal transfer, comprising:

introducing a recording paper into an apparatus;

moving the recording paper along a platen roller in a first direction;

discharging the recording paper from the apparatus;

generating a change-over signal to rotate a first cam gear in a second direction opposite to the first direction;

shifting a change-over slider in response to rotation of the first cam gear;

rotating a change-over arm in response to shifting of the change-over slider;

moving a change-over gear between a first position where a drum gear associated with the platen roller and having a larger gear portion is engaged with a smaller gear portion of the change-over gear and a second position where a smaller gear portion of the drum gear is engaged with a larger gear portion of the change-over gear;

coordinating movement of a thermal head from a non-print enabling location spaced from the platen roll into a print enabling location in contact with overlapped ink ribbon and recording paper supported by the platen roller to effect transfer recording with movement of the change-over gear to the first position; and moving the change-over gear to a neutral position intermediate the first and second positions and in a predetermined axial space between the larger gear portion and smaller gear portion of the drum gear to allow the platen roller to rotate freely.

* * * * *